US006672399B2

(12) United States Patent
Sprinkle et al.

(10) Patent No.: US 6,672,399 B2
(45) Date of Patent: Jan. 6, 2004

(54) HYDRAULIC DIVERTING SYSTEM FOR UTILITY VEHICLE

(75) Inventors: David Laverne Sprinkle, Warrenton, GA (US); Robert D. Cork, Grovetown, GA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/041,831

(22) Filed: Oct. 19, 2001

(65) Prior Publication Data

US 2003/0074811 A1 Apr. 24, 2003

(51) Int. Cl.[7] ..... A01B 63/112
(52) U.S. Cl. ..... 172/7; 91/402; 60/421
(58) Field of Search ..... 37/347, 348; 419/795.9, 419/796; 60/420, 452, 426, 421; 91/432, 189 R, 402; 172/2–11

(56) References Cited

U.S. PATENT DOCUMENTS 3,795,327 A * 3/1974 Grey et al. ..... 414/795.9
3,804,267 A * 4/1974 Cook et al. ..... 414/795.9
3,990,520 A 11/1976 Koch et al.
4,216,975 A 8/1980 Schafer
4,335,577 A 6/1982 Lobmeyer et al.
4,837,691 A 6/1989 Boe et al.
5,419,129 A 5/1995 Becker et al.
5,558,163 A 9/1996 Hollstein

* cited by examiner

*Primary Examiner*—Robert E. Pezzuto
(74) *Attorney, Agent, or Firm*—Polit & Erickson, LLC

(57) ABSTRACT

A hydraulic fluid diverting arrangement for a utility vehicle provides additional pressurized hydraulic fluid supply to an installed backhoe attachment by diverting hydraulic fluid from the unused rockshaft or three-point hitch of the utility vehicle. A solenoid operated valve manifold is switch actuated by contact from the backhoe during installation of the backhoe to the utility vehicle and diverts hydraulic fluid flow from rockshaft hydraulic cylinders to backhoe hydraulic cylinders. The system increases the available horsepower to the backhoe by using hydraulic fluid otherwise dedicated to the idle rockshaft.

16 Claims, 4 Drawing Sheets

HYDRAULIC DIVERTING SYSTEM FOR UTILITY VEHICLE

TECHNICAL FIELD OF THE INVENTION

The present invention relates to utility vehicles, such as industrial or agricultural tractors. Particularly, the invention relates to tractors utilizing a rockshaft or three point hitch and an attachable rear-mounted implement.

BACKGROUND OF THE INVENTION

Utility vehicles typically include an internal combustion engine, which delivers power to a transmission and ultimately to a wheel for traction, and also delivers power to pressurize hydraulic fluid, via one or more pumps, to operate hydraulic tools or implements.

In this regard, it is known to provide three hydraulic pumps driven from the engine. A first pump generates pressurized hydraulic fluid to charge a steering cylinder of the vehicle. A second pump generates pressurized hydraulic fluid to charge a power takeoff clutch pack and at least one hydraulic cylinder which operates a three point hitch or "rockshaft." The power takeoff is a shaft that is rotated by the vehicle transmission and is used for supplying rotational power to tools, such as mower decks, where rotation is required. The first and second pumps are driven by an auxiliary drive of the engine.

The third pump is usually fixed directly to the crankshaft of the engine and is used to charge pressurized hydraulic fluid to the loader and the backhoe hydraulic cylinders.

Typically, the first pump requires 1.4~8 horsepower, depending on steering demand and 6 GPM of hydraulic fluid. The second pump requires 1~9.5 horsepower, depending on demand from the auxiliary circuit, and 5.4 GPM of hydraulic fluid. The third pump requires 3.2~21.3 horsepower, depending on demand from loader or backhoe circuits and 12 GPM of hydraulic fluid. The engine typically delivers 42 horsepower.

When a backhoe is attached to the utility vehicle, the rockshaft is not needed, nor is it practically operable. The present inventors have recognized the desirability of disabling the rockshaft when a backhoe is attached to the utility vehicle. The present inventors have recognized the desirability of diverting hydraulic fluid that would otherwise supply the rockshaft, when the backhoe attachment is attached. Furthermore, the present inventors have recognized the desirability of using the circulating hydraulic fluid otherwise available to the rockshaft, to improve the effectiveness and efficiency of the utility vehicle.

The present inventors have recognized that a proper balance of available engine horsepower directed to the various tractor functions at the proper time is required for best operation of the machine. While the loader is in use, the transmission must necessarily also be in use simultaneously. As such, it is desirable to limit the available horsepower consumed in the operation of the loader while demands are placed on the transmission, to prevent engine stalling.

Conversely, the inventors have recognized that the backhoe is used without demand on the loader, transmission, rockshaft, or steering circuits. Furthermore, the backhoe has very high hydraulic power requirements. This is because in normal operation, 3 or more hydraulic cylinders (of a typical 7 total cylinders) may be in motion at any given time For this reason, the inventors have recognized that it would be desirable to utilize additional flow from tractor systems which are sitting idle while the backhoe is in use.

SUMMARY OF THE INVENTION

The present invention provides a method and apparatus for diverting pressurized hydraulic fluid, otherwise available to a utility vehicle rockshaft system, to be used by another hydraulic fluid powered implement on the utility vehicle. Particularly, the invention provides a method and apparatus for diverting pressurized hydraulic fluid from the rockshaft hydraulic system to be available to a backhoe attachment hydraulic system.

The method and apparatus of the invention are advantageously accomplished by use of a rockshaft disable switch. The switch is placed in a position such that installation of the backhoe attachment on the utility vehicle automatically changes the state of the switch.

The switch is connected to a solenoid operator that moves a valve spool to divert pressurized hydraulic fluid from a rockshaft control valve to other hydraulically operated tools, such as to the backhoe attachment. Additional hydraulic fluid available to the backhoe attachment allows for faster movements of the backhoe attachment operating hydraulic cylinders, and thus faster manipulations of the backhoe arms and backhoe bucket.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
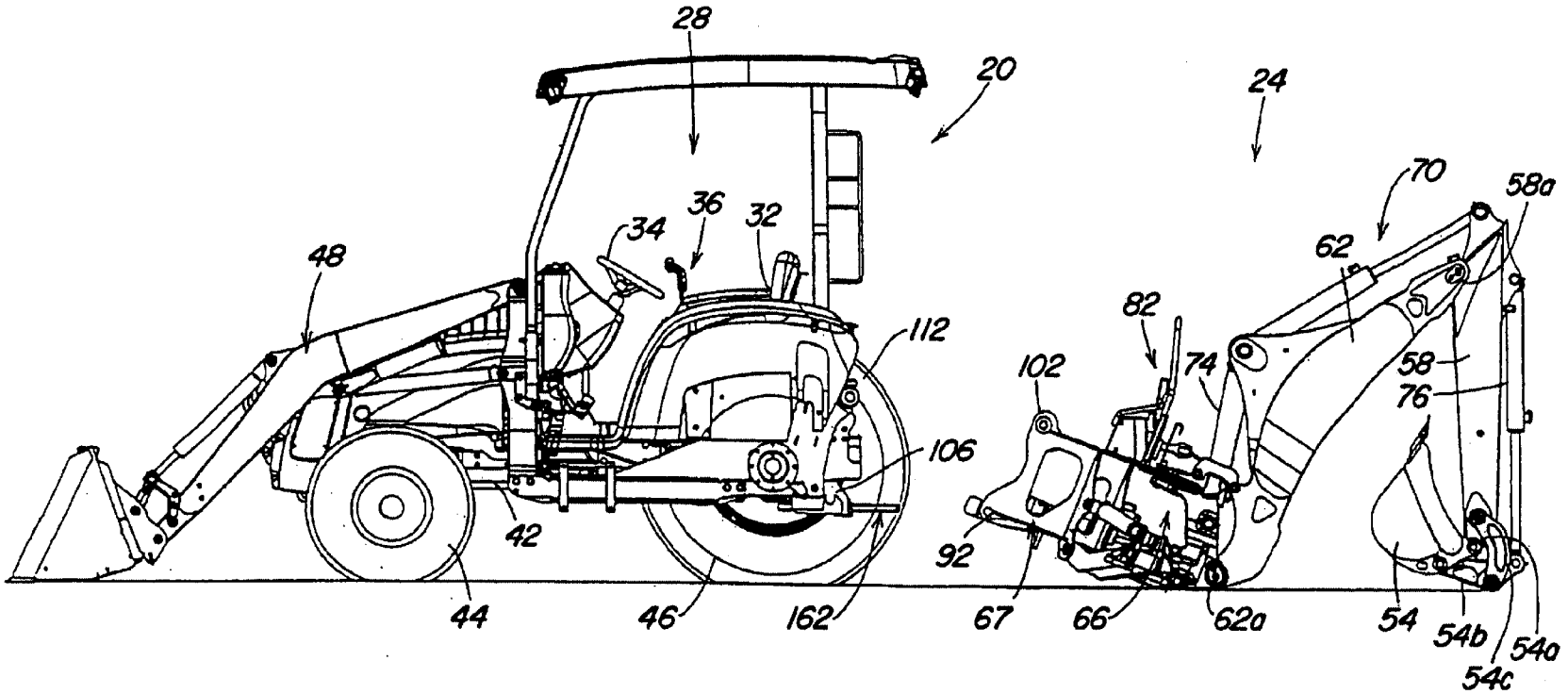
FIG. 1 is a fragmentary elevational view of a tractor incorporating the present invention with a foreground rear wheel removed to view portions behind the wheel.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a utility vehicle 20 with an attachable rear-mounted implement, such as a backhoe attachment 24. The utility vehicle 20 includes a cab or operator's station 28 including a seat 32, a steering wheel 34, and loader controls 36. The cab is supported on a chassis 42 which is supported on front wheels 44 and larger rear wheels 46. The utility vehicle 20 can be equipped with a front mounted loader assembly 48.

The backhoe attachment 24 includes a bucket 54, a distal arm or dipperstick 58, an intermediate arm or boom arm 62, a swivel arm or swivel tower 66 and a base assembly or mainframe 67. The distal arm 58 can be pivoted about a point 58*a* with respect to the intermediate arm 62 by a hydraulic cylinder 70. The intermediate arm 62 can be pivoted about a point 62*a* with respect to the swivel arm 66 by a boom cylinder 74. The swivel arm 66 can be swung about a vertical axis with respect to the base assembly 67. The bucket 54 can be rotated about a point 54*a* with respect to the first arm 58 by a hydraulic cylinder 76 and linkages 54*b*, 54*c*. The operation of the hydraulic cylinders is by rear-mounted controls 82.

The backhoe base assembly 67 includes laterally directed, laterally spaced apart, round bars 92 (one shown) extending on opposite sides of the base assembly 67 on a bottom thereof. The base assembly 67 further includes laterally spaced apart cylinder bosses 102 (one shown) located substantially above the round bars 92 and extending laterally on opposite sides of the base assembly. The bars 92 and bosses 102 are arranged in mirror image symmetrical fashion across a longitudinal vertical plane.

The utility vehicle chassis 42 includes a mounting structure 42*a* comprising hooks or seats 106 (one shown) opened upwardly and located on opposite lateral sides of the rear portion of the chassis 42. The seats 106 are sized and shaped to each receive a round bar 92 therein. The mounting structure 42*a* further includes two laterally spaced apart receivers 112 (one shown) which are sized and shaped to receive the bosses 102 therein. The receivers 112 are open substantially horizontally toward the backhoe attachment. The mounting structure 42*a* is configured in mirror image symmetrical fashion across a longitudinal vertical plane.

Figure 2:
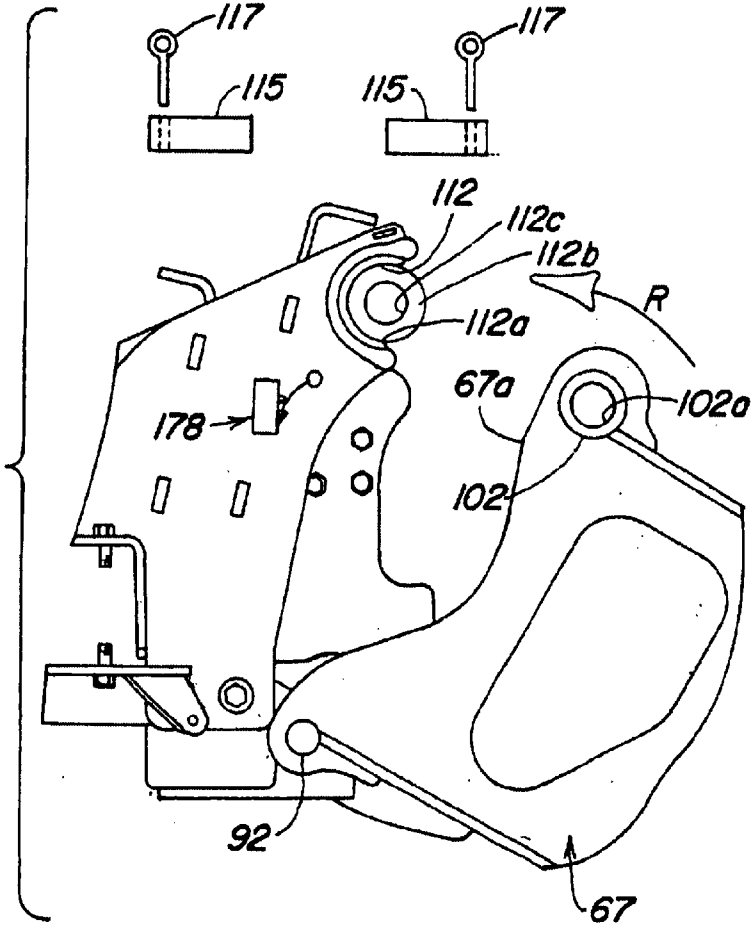
FIG. 2 is an enlarged fragmentary elevational view of a backhoe attachment being installed on the tractor of FIG. 1.

FIG. 2 illustrates, in an enlarged view, the base assembly 67 of the backhoe attachment 24 partially engaged to the utility vehicle 20. The round bars 92 are already fit into the seats 106. The boss cylinders 102 are then rotated up to engage the receivers 112, 114. The receivers 112 each include a semi-circular rim portion 112*a* and a pin receiving cylinder 112*b* having a base 112*c*. Each boss 102 includes a central bore 102*a*. When a boss 102 is fit into the receiver rim portions 112*a* the bore 102*a* aligns with the bore 112*c* as the boss 102 fits coaxially against the cylinder portion 112*b*. Two cylindrical connector pins 115 are fit through the central bores 102*a* of the bosses 102, respectively, and through the adjacent bores 112*c* of the cylinder portions 112*b* of the receivers 112 to lock the backhoe attachment 24 to the utility vehicle 20. Means, such as a radial locking pin 117 that penetrates the cylinder 112 or the boss 102 and the connector pin 115, can be provided to lock the connector pins 115 in place.

The backhoe attachment is removeable by removing the connector pins 115 when it is desired to install a different rear attachment, such as a mower deck, or a tiller.

Figure 3:
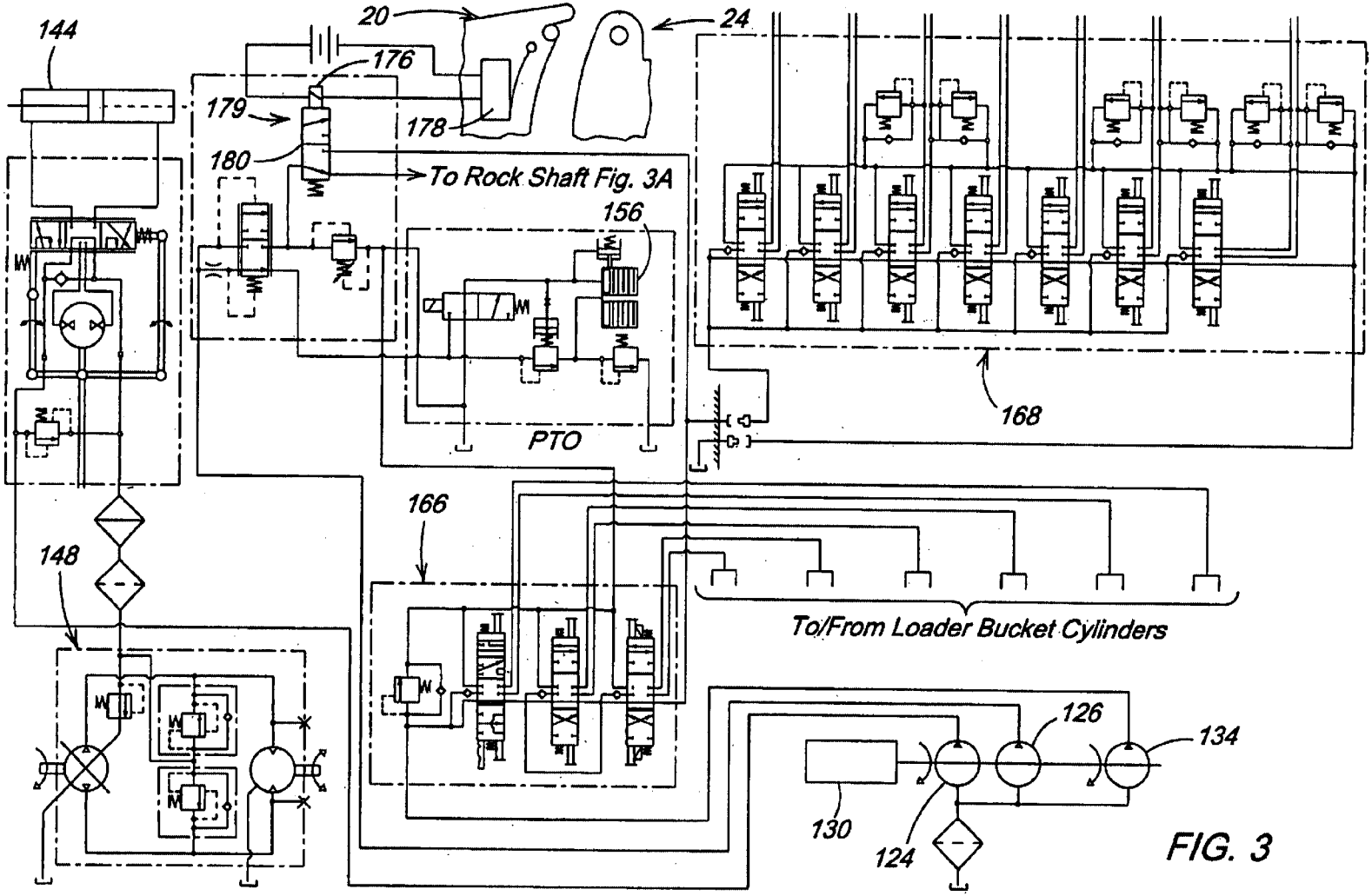
FIG. 3 is a schematic diagram of a hydraulic fluid system of the tractor shown in FIG. 1.

FIG. 3 illustrates a hydraulic system 120 of the invention. The hydraulic system 120 is charged by three pumps. A first pump 124 and a second pump 126 are driven by the auxiliary drive of an engine 130. A third pump 134 is driven by the crankshaft of the engine 130. The first pump 124 charges the power steering system 142 and ultimately powers a steering cylinder 144. Hydraulic fluid out of the steering system 142 charges a hydrostatic transmission 148 which transfers power from the engine to the utility vehicle gear train. The second pump 126 charges a power takeoff system clutch pack 156, and a rockshaft system 162, particularly directing hydraulic fluid through a rockshaft selective control valve 163 (shown in FIG. 3A) which powers at least one rockshaft hydraulic cylinder 164 (shown in FIG. 3A). The hydraulic cylinder(s) 164 controls vertical and/or attitude and/or pitch adjustment of the three-point hitch.

The third pump 134 charges a loader selective control valve 166 and a backhoe selective control valve 168. The selective control valves 166, 168 each include an operation control lever for precise manipulation of hydraulic cylinders which control movements of the associated implement.

According to the invention, a diverter valve in the form of a spool valve or cartridge valve 174 is hydraulically connected to pressurized hydraulic fluid from the second pump 126. In the absence of the backhoe attachment, a solenoid 176 of the valve 174 is normally energized, to overcome spring force, to deliver pressurized hydraulic fluid to the clutch pack 156 and to the rockshaft system 162. When the backhoe attachment is subsequently installed onto the utility vehicle 20, the backhoe attachment 24 makes contact with, and trips a switch 178 such that power is disconnected from the solenoid 176 and spring force moves a spool 180 of the valve 174 to connect the backhoe system to pressurized hydraulic fluid from the second pump 126, and to simultaneously disconnect pressurized hydraulic fluid to the rockshaft system 162.

By causing this diversion of hydraulic fluid, the third pump 134 can be made correspondingly smaller, having less fluid capacity. The second pump 126, which is needed for rockshaft operation, but heretofore represented unused capacity during backhoe operation, can now be used to increase total pump capacity to the backhoe attachment.

The size of the pump 134 is typically selected to correspond to the total horsepower demand of the front loader, via the valve 166. The engine is typically sized to provide reserve power over the horsepower demand of the loader to power the hydrostatic transmission 148 during loader work, when the backhoe is not in use. Thus, sufficient engine horsepower is available to drive both pumps 126, 134 to supply the backhoe with increased hydraulic capacity. The invention is therefore particularly advantageous to retrofit existing utility vehicles or existing designs for utility vehicles.

Figure 3A:
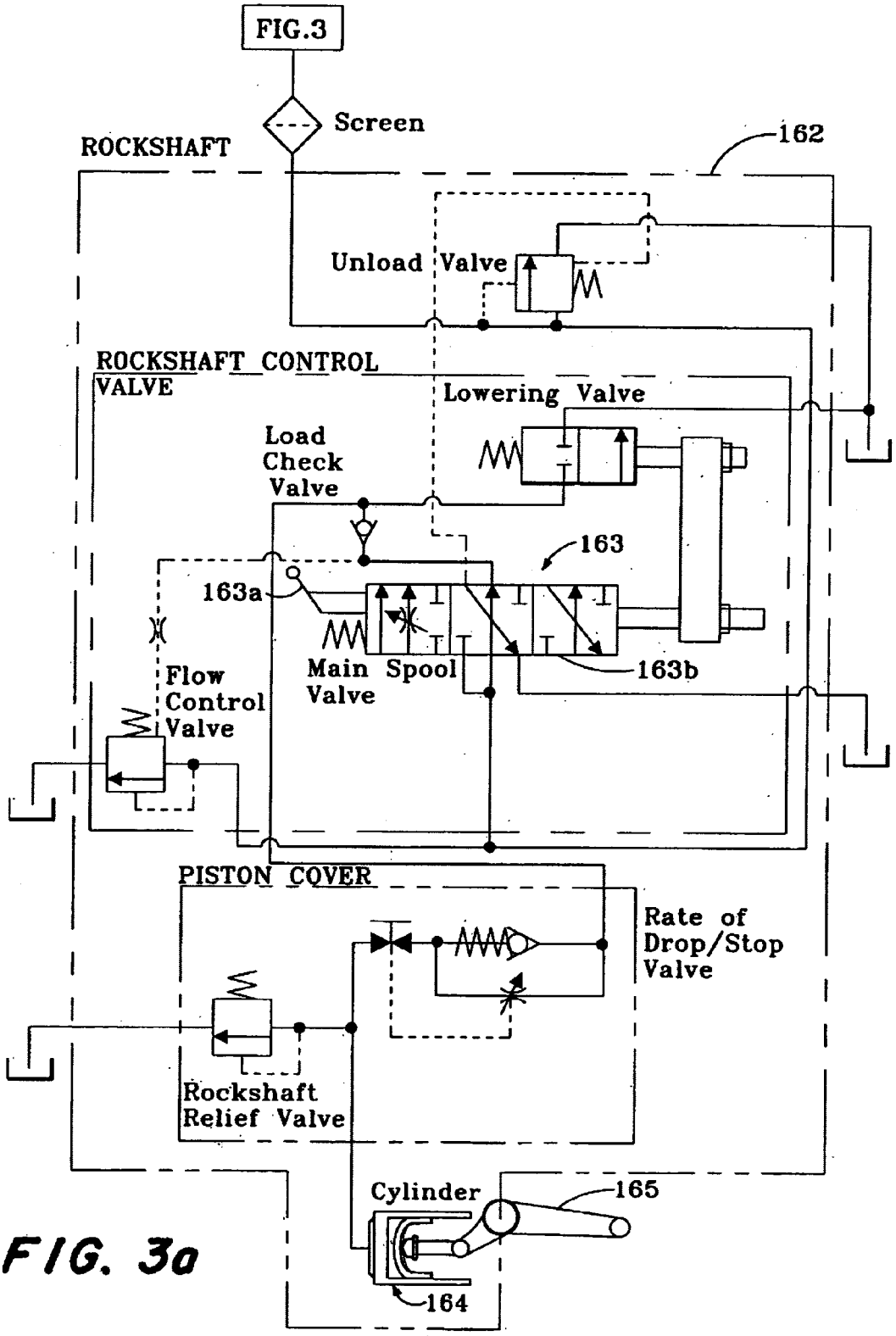
FIG. 3A is a schematic diagram of a rockshaft control system of FIG. 3.

FIG. 3A illustrates a rockshaft or three point hitch control scheme including the rockshaft control valve 163 having an operator controlled lever 163*a* for manipulating a valve spool 163*b*. The spool 163*b* communicates pressurized hydraulic fluid through a system of valves to the hydraulic cylinder 164. The hydraulic cylinder 164 includes a rod that is configured to extend or retract to pivot a hitch arm 165 to adjust the rockshaft. Although one cylinder 164 is shown, plural cylinders 164 can be used to adjust height, attitude, pitch, etc. Other rockshaft or three point hitch systems are disclosed in U.S. Pat. Nos. 6,216,072; 5,152,347; 4,216,975; and 3,990,520, all herein incorporated by reference.

Figure 4:
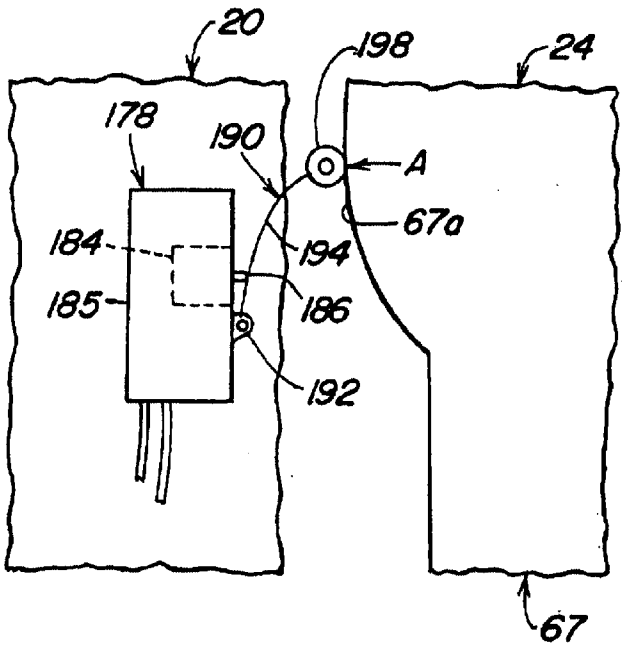
FIG. 4 is an enlarged diagrammatic view of a rockshaft disable switch mounted to a surface of a tractor.

FIG. 4 illustrates the switch 178 in more detail. The switch includes a switch component 184 which can be a commercially available switch. The component 84 can be mounted on or in a frame or box 185. The switch component 184 includes a switch button or trigger 186. The trigger can be a momentary switch which must be continuously depressed to maintain an actuated state. A resilient switch lever 190 is mounted to the frame 185 at an attachment point 192. The switch 190 includes a button engaging portion 194, an extending portion 196, and a roller portion 198 mounted to the extending portion 196.

When the backhoe is installed, a surface 67*a* of the backhoe attachment base assembly 67 presses the roller portion 198 in the direction A, which pivots the extending portion 196 and the engaging portion 194 about the attachment point 192 to press the button 186 inwardly, to change the state of the switch component 184, i.e. to open (or alternatively to close) the switch component 184. An electrical signal is thus sent to the solenoid 176 and hydraulic fluid is thus diverted from the rockshaft to the backhoe attachment. When the backhoe attachment is removed, the lever 190 springs away from the button 186 to change the state of the switch component, i.e. to close (or alternably to open) the switch component 184, and hydraulic fluid is diverted back to the rockshaft system.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. In a utility vehicle, a selection system for providing pressurized hydraulic fluid to a rockshaft hydraulic system and an implement hydraulic system, comprising:

a diverter valve;

a first pump hydraulically connected for providing a first flow of pressurized hydraulic fluid to said diverter valve, said diverter valve configured to control direction of said first flow to operate either a rockshaft hydraulic system, or an implement hydraulic system on the utility vehicle.

2. The selection system according to claim 1, wherein said rockshaft hydraulic system comprises at least one first hydraulic cylinder and said implement hydraulic system comprises at least one second hydraulic cylinder, and said diverter valve comprises a solenoid valve, and said selection system comprises a switch connected between a source of power and to said solenoid valve, changing the state of said switch changes the state of said solenoid valve to cause diversion of said first flow of pressurized hydraulic fluid from said at least one first hydraulic cylinder to said at least one second hydraulic cylinder.

3. The selection system according to claim 2, comprising a second pump hydraulically connected to said at least one second hydraulic cylinder, and wherein said first flow comprises about 4 GPM of pressurized hydraulic fluid, and said second pump is sized to provide about 12 GPM of pressurized hydraulic fluid.

4. The selection system according to claim 2, comprising a second pump hydraulically connected to said at least one second hydraulic cylinder, and wherein said first flow is about one-third the flow provided by said second pump to said at leapt one second hydraulic cylinder.

5. The selection system according to claim 1, wherein said rockshaft hydraulic system comprises at least one first hydraulic cylinder and said implement hydraulic system comprises at least one second hydraulic cylinder, and said selection system comprises a switch, changing the state of said switch causes diversion of said first flow of pressurized hydraulic fluid from said at least one first hydraulic cylinder to said at least one second hydraulic cylinder.

6. The selection system according to claim 5, wherein said implement comprises a backhoe attachment and said switch comprises a trigger mounted to said utility vehicle to be actuated by contact from said backhoe attachment during installation of said backhoe attachment to said utility vehicle.

7. The selection system according to claim 1, wherein said diverter valve is automatically actuated by the attachment of the implement to the utility vehicle.

8. In a utility vehicle, a selection system for providing pressurized hydraulic fluid to a rockshaft hydraulic system and an implement hydraulic system, comprising:

a diverter valve;

a first pump hydraulically connected for providing a first flow of pressurized hydraulic fluid to said diverter valve, said diverter valve configured to control direction of said first flow to operate either a rockshaft hydraulic system, or an implement hydraulic system on the utility vehicle;

wherein said rockshaft hydraulic system comprises at least one first hydraulic cylinder and said implement hydraulic system comprises at least one second hydraulic cylinder, and said diverter valve comprises a solenoid valve, and said selection system comprises a switch connected between a source of power and to said solenoid valve, changing the state of said switch changes the state of said solenoid valve to cause diversion of said first flow of pressurized hydraulic fluid from said at least one first hydraulic cylinder to said at least one second hydraulic cylinder; and wherein said implement comprises a backhoe attachment and said switch comprises a trigger mounted to said utility vehicle to be actuated by contact from said backhoe attachment during installation of said backhoe attachment to said utility vehicle.

9. The selection system according to claim 8, comprising a second pump hydraulically connected to said at least one second hydraulic cylinder, and wherein said first flow comprises about 4 GPM of pressurized hydraulic fluid, and said second pump is sized to provide about 12 GPM of pressurized hydraulic fluid.

10. The selection system according to claim 8, comprising a second pump hydraulically connected to said at least one second hydraulic cylinder, and wherein said first flow is about one-third the flow provided by said second pump to said at least one second hydraulic cylinder.

11. A method of supplying pressurized hydraulic fluid to a rockshaft and to a backhoe on a utility vehicle, comprising the steps of:

before a backhoe is installed onto the vehicle, supplying a first flow quantity of pressurized hydraulic fluid to at least one first hydraulic cylinder operating a rockshaft; and when the backhoe is installed onto the vehicle, automatically diverting the first flow quantity of pressurized hydraulic fluid to at least one second hydraulic cylinder operating the backhoe.

12. The method according to claim 11, wherein said step of diverting the first flow quantity of pressurized hydraulic fluid is further defined in that said step is automatically accomplished by the installation of the backhoe onto the utility vehicle.

13. The method according to claim 11, wherein said step of supplying is further defined in that before a backhoe is installed onto the vehicle, said first flow quantity of pressurized hydraulic fluid is supplied by a first pump and after installation of said backhoe, a second flow quantity of pressurized hydraulic fluid is supplied to said second hydraulic cylinder by a second pump, additive to said first flow quantity of pressurized hydraulic fluid.

14. In a tractor, a selection system for providing pressurized hydraulic fluid to a hitch hydraulic system and a backhoe hydraulic system, comprising:

a hitch having a hitch hydraulic system and a backhoe having a backhoe hydraulic system;

a diverter valve;

a first pump hydraulically connected for providing a first flow of pressurized hydraulic fluid to said diverter valve, said diverter valve configured to control direction of said first flow to operate either a hitch hydraulic system, or a backhoe hydraulic system on the tractor;

wherein said hitch hydraulic system comprises at least one first hydraulic cylinder for adjusting an elevation of said hitch and said backhoe hydraulic system comprises at least one second hydraulic cylinder, and said diverter valve comprises a solenoid valve, and said selection system comprises a switch connected between a source of power and to said solenoid valve, changing the state of said switch changes the state of said solenoid valve to cause diversion of said first flow of pressurized hydraulic fluid from said at least one first hydraulic cylinder to said at least one second hydraulic cylinder; and wherein said backhoe comprises a backhoe attachment and said switch comprises a trigger mounted to said utility vehicle to be actuated by contact from said backhoe attachment during installation of said backhoe attachment to said tractor.

15. The selection system according to claim 14, comprising a second pump hydraulically connected to said at least one second hydraulic cylinder, and wherein said first flow comprises about 4 GPM of pressurized hydraulic fluid, and said second pump is sized to provide about 12 GPM of pressurized hydraulic fluid.

16. The selection system according to claim 14, comprising a second pump hydraulically connected to said at least one second hydraulic cylinder, and wherein said first flow is about one-third the flow provided by said second pump to said at least one second hydraulic cylinder.

* * * * *